US007703173B2

(12) United States Patent
Tagliaferri

(10) Patent No.: US 7,703,173 B2
(45) Date of Patent: Apr. 27, 2010

(54) SELF-PROPELLED APPARATUS FOR CLEANING ROADS AND URBAN ARES

(75) Inventor: Fabrizio Tagliaferri, Trecasali (IT)

(73) Assignee: Dulevo International, S.p.A., Saguinaro di Fontanellato (Parma) (IT)

( * ) Notice: Subject to any disclaimer, the term of this patent is extended or adjusted under 35 U.S.C. 154(b) by 135 days.

(21) Appl. No.: 11/825,090

(22) Filed: Jul. 3, 2007

(65) Prior Publication Data

US 2008/0005864 A1 Jan. 10, 2008

(30) Foreign Application Priority Data

Jul. 7, 2006 (IT) ..... MI2006A1321

(51) Int. Cl.
*E01H 1/08* (2006.01)

(52) U.S. Cl. ..... 15/340.4; 15/340.3

(58) Field of Classification Search ..... 15/340.1, 15/340.3, 340.4, 49.1, 50.1, 98; 180/211, 180/213–216, 409
See application file for complete search history.

(56) References Cited

U.S. PATENT DOCUMENTS 3,860,991 A * 1/1975 Heidt ..... 15/340.4
4,884,313 A * 12/1989 Zoni ..... 15/340.3
5,890,558 A * 4/1999 Keegan ..... 180/211
6,212,731 B1 * 4/2001 Eckerlein et al. ..... 15/320
6,444,003 B1 * 9/2002 Sutcliffe ..... 55/385.1
2007/0124892 A1 * 6/2007 Adair et al. ..... 15/340.3
2007/0163071 A1 * 7/2007 Bussolotti et al. ..... 15/340.1

* cited by examiner

*Primary Examiner*—Dung Van Nguyen
(74) *Attorney, Agent, or Firm*—R. Ruschena Patent Agent, LLC

(57) ABSTRACT

There is disclosed a self-propelled apparatus for cleaning roads and urban areas, having a longitudinal axis (1*a*) and comprising: propulsion and control members (2) including wheels and steering means (3) defining an axis of steering (3*b*) perpendicular to the longitudinal axis (1*a*) and passing through the centre of turning (3*a*) of the wheels; an accumulation system (8) on the ground of the refuse comprising brushes (11) defining a reference line (10*a*) transverse to the longitudinal axis (1*a*); and a collection system (12) to suck up the refuse comprising a collection inlet (13) positioned at ground level; the steering means (3), the accumulation system (8) and the collection system (12) being predisposed suitably to dispose said axis of steering (3*a*) in a position intersecting a segment (15) parallel to the longitudinal axis (1*a*) and extending between the collection inlet (13) and the reference line (10*a*).

5 Claims, 2 Drawing Sheets

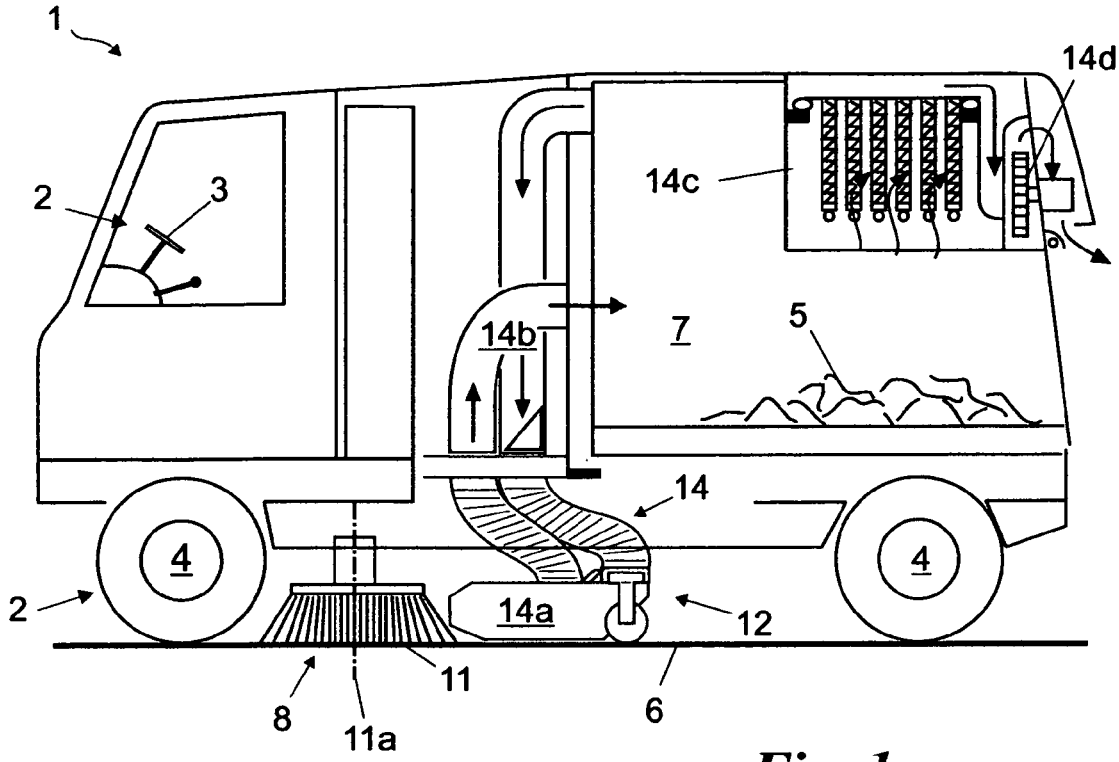
*Fig. 1*
*Fig. 2*
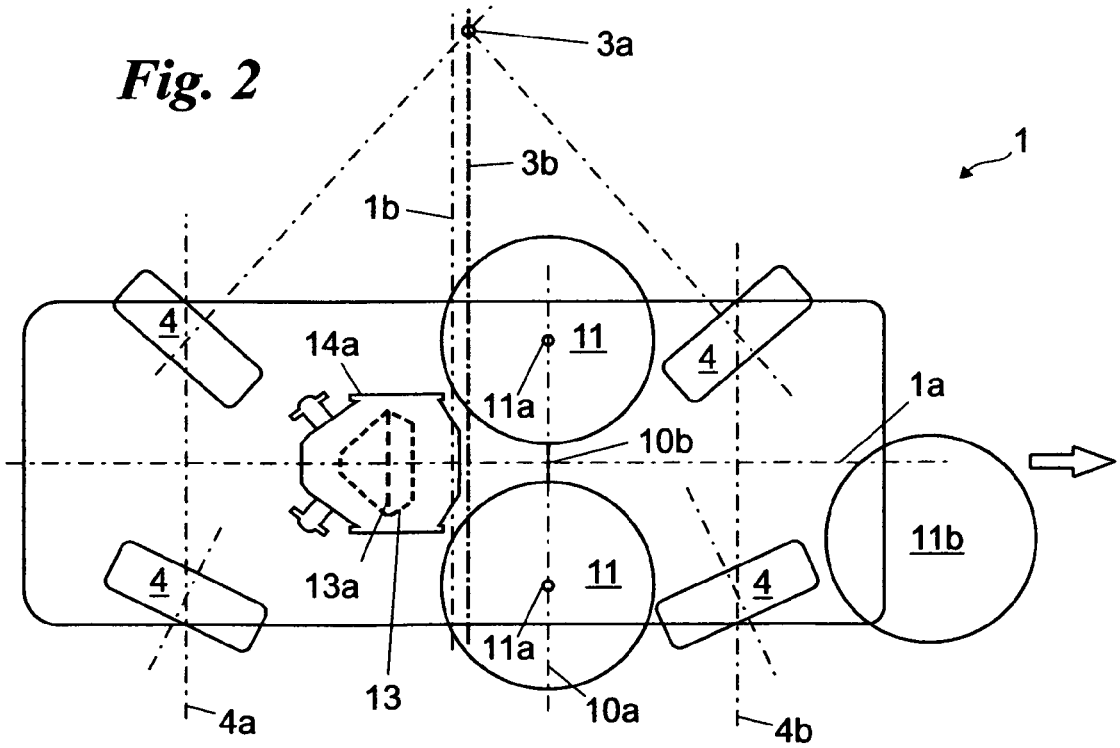

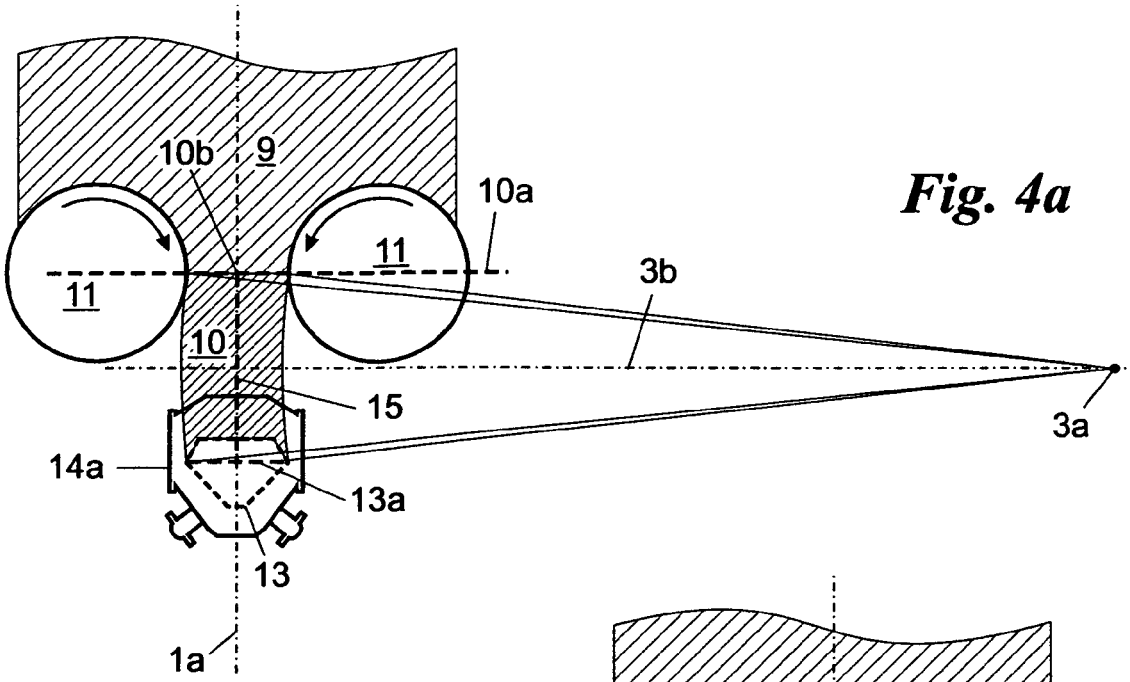
Fig. 4a
Fig. 3
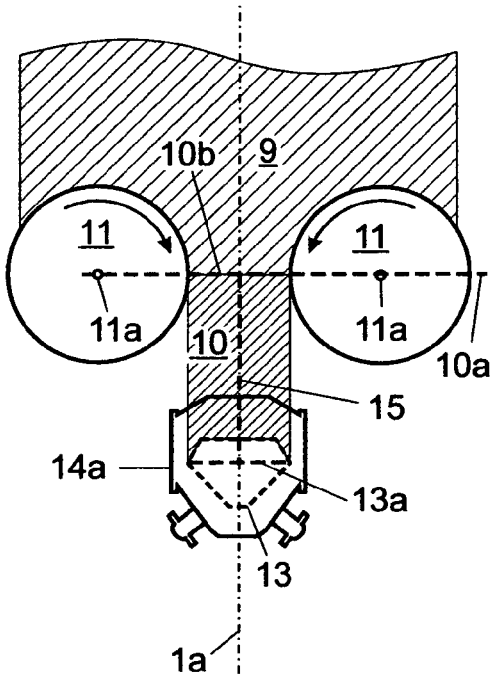
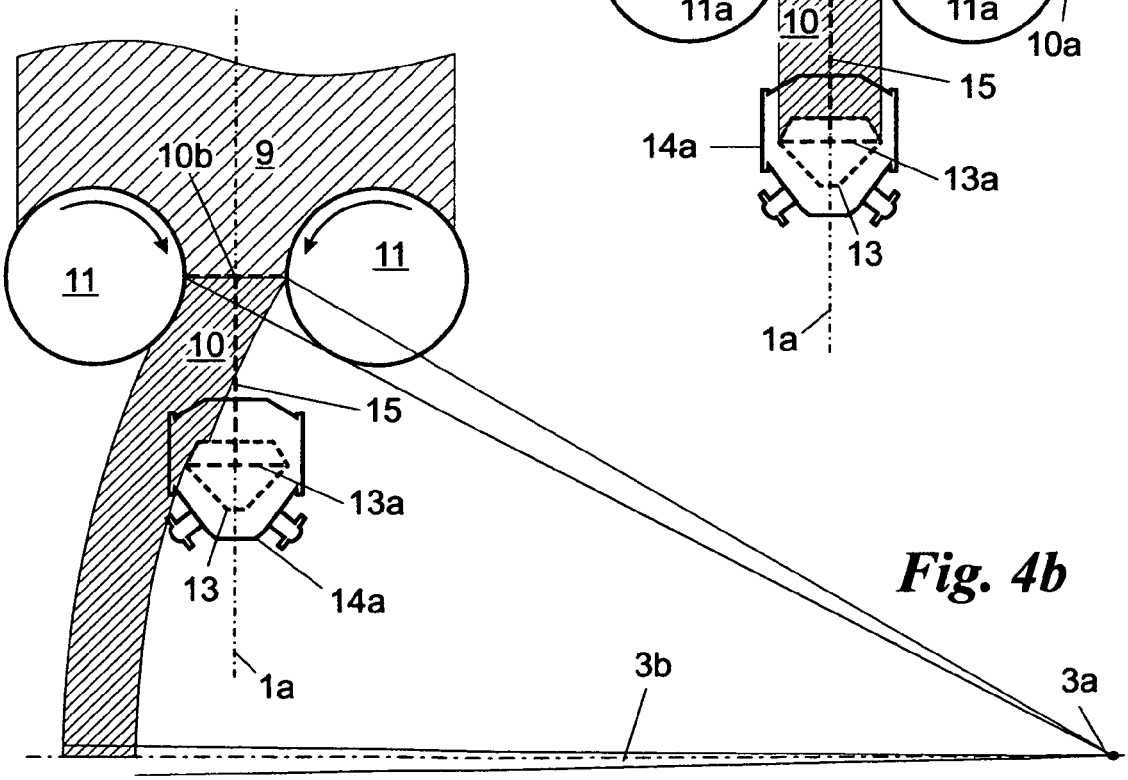
Fig. 4b

SELF-PROPELLED APPARATUS FOR CLEANING ROADS AND URBAN ARES

FIELD OF THE INVENTION

The invention relates to a self-propelled apparatus for cleaning roads and urban areas, of the type comprising: propulsion and control members including wheels and steering means of said wheels, an accumulation system of refuse on the ground comprising at least two brushes, and a collection system to suck up said refuse comprising a collection inlet positioned substantially at ground level.

DESCRIPTION OF THE PRIOR ART

There are currently known self-propelled apparatus for cleaning roads and the like.

These are substantially realized by vehicles of various dimensions including an engine and various control means, in particular steering members of the wheels. These apparatus are suitable to sweep the ground and collect refuse of various sizes: from macroscopic refuse such as bottles, cans and the like, to refuse of minimum dimensions such as dusts. They are used in particular for roads, pavements, large indoor spaces, shopping malls, etc.

The sweeping and collection operations firstly provide for accumulation of the refuse in a specific area. Therefore, there exist refuse accumulation systems principally realized by brushes, in particular circular truncated-cone shaped brushes with axis of rotation substantially vertical or in any case transverse to the ground, known as "cup" brushes, which operate by positioning the refuse, originally scattered over a vast area, in a narrow accumulation strip.

There are then provided collection systems that pick up the refuse from said narrow accumulation strip to deposit it in a specific container.

The collection systems that particularly concern the present invention are based on the use of suction members that have a collection inlet in proximity to the ground.

Vehicles, accumulation systems and collection systems are normally realized with a view to optimizing the respective driving, accumulation and collection operations. Each is also positioned in relation to the obstructions or spaces available.

The aforesaid prior art has some important drawbacks.

In fact, in particular when said movable cleaning apparatus is travelling in a curve, the refuse accumulated by said accumulation systems, in particular by the cup brushes, often are not completely sucked up by said collection systems, in particular by the collection inlet.

In fact, in urban areas, where various manoeuvres are required and trajectories with very narrow curves between obstructions of various kinds must be traveled, it is easy to find portions of the accumulation strips wherein the refuse has not been collected, due to the presence of different trajectories between the cup brushes and the collection inlet, positioned in different points of the self-propelled apparatus.

This drawback can be partially remedied by means of the use of very wide collection inlets. Nonetheless, this solution is neither economical nor always effective, in particular for cleaning apparatus equipped with a suction collection system.

In fact, if the suction area increases, i.e. the dimension of the collection inlet, in order not to reduce the efficiency of the system it is also necessary to increase the suction power. This increase in power nonetheless results in increased costs and very complex systems.

Moreover, it is not always possible to increase the width of collection systems due to the dimensional and technical constraints inherent to the apparatus. Likewise, due to said constraints in many cases it is not possible or advisable to place the collection inlet very close to the cup brushes, to immediately collect the refuse conveyed thereby.

Therefore, there exists the unsolved technical problem of how to obtain a self-propelled apparatus for cleaning roads and urban areas capable of sweeping the entire accumulation area of the refuse and of maintaining low energy consumption and reduced dimensions, as well as a certain degree of freedom in positioning the collection systems, in particular when these are based on the use of suction members having a collection inlet in proximity to the ground.

SUMMARY OF THE INVENTION

In this situation the technical aim underlying the present invention is to devise a self-propelled apparatus capable of substantially overcoming the aforesaid drawbacks.

Within said technical aim, an important object of the invention is to realize a self-propelled apparatus capable of sweeping the entire area or strip in which the refuse is accumulated, also in the presence of brushes and collection inlets spaced from each other and also in the presence of a suction system having a collection inlet of relatively small dimensions and low energy consumption.

The technical aim is achieved by a self-propelled apparatus for cleaning roads and urban areas, having a longitudinal axis parallel to the direction of rectilinear motion, comprising: propulsion and control members including wheels and steering means of the wheels, the steering means defining a centre of turning and an axis of steering perpendicular to the longitudinal axis and passing through the centre of turning, an accumulation system of refuse on the ground comprising at least two brushes having at ground level centres of rotation spaced from each other and defining a reference line transverse to the longitudinal axis, and a collection system to suck up the refuse comprising a collection inlet positioned substantially at ground level, the steering means, the accumulation system and the collection system being predisposed suitably to dispose the axis of steering in a position intersecting a segment parallel to the longitudinal axis and extending between the collection inlet and the reference line.

BRIEF DESCRIPTION OF THE DRAWINGS

Further characteristics and advantages of the invention are better explained hereunder by the detailed description of a preferred embodiment of the invention, with reference to the accompanying drawings, wherein:

FIG. 1 shows the apparatus in an elevation and in its entirety;

FIG. 2 schematizes in a top view the fundamental elements of the apparatus according to the invention;

FIG. 3 highlights the operation of some portions of the apparatus according to the invention, while travelling in a straight line;

FIG. 4*a* shows operation of some portions of the apparatus according to the invention, while travelling in a curve; and FIG. 4*b* highlights—for immediate comparison—operation of an apparatus according to prior art, while travelling in a curve.

DESCRIPTION OF THE PREFERRED EMBODIMENTS

With reference to the aforesaid Figures, the self-propelled apparatus 1 according to the invention is indicated as a whole with the number 1.

It has a frame extending along a longitudinal axis 1*a*, defining a longitudinal direction or direction of rectilinear motion, and a transverse axis 1*b*, defining a transverse direction perpendicular to the longitudinal direction.

The apparatus comprises briefly propulsion and control members 2 such as an engine and steering means 3, and at least three wheels 4, more preferably four wheels 4, disposed along two axes 4*a* and 4*b*, rear and front, substantially parallel to the transverse axis 1*b*.

The wheels 4 and the steering means 3 are suitable to allow the apparatus 1 to travel in a curve, by means of steering around a point called centre of turning 3*a*, positioned on the axis of steering 3*b*, passing through the centre of turning 3*a* and parallel to the transverse axis 1*b*.

In the presence of front steered wheels only, the axis of steering 3*b* coincides with the rear axis 4*a* of the rear wheels.

Instead when all four wheels 4 are steered, as shown in FIG. 2, the axis of steering 3*b*, passing through the centre of turning 3*a*, does not coincide with the axis of the rear wheels, but is disposed between the two rear and front axes 4*a* and 4*b*.

As specified in the first part of the present patent, the apparatus 1 is suitable to clean roads and urban areas, therefore to collect refuse 5 from the ground 6.

The term refuse 5 is intended as waste, residues or scraps ranging from macroscopic dimensions, i.e. with sizes in the order of centimeters and decimetres, such as cans, bottles and the like, and minimum dimensions, in particular dusts.

The apparatus 1 also comprises a container 7 for the refuse 5, preferably closed.

It also comprises an accumulation system 8 of the refuse on the ground suitable to convey the refuse located over a wide cleaning area 9 into a narrower accumulation strip 10.

The accumulation strip 10 is substantially realized by the projection, according to the trajectory traveled by the apparatus 1, of a conveying stretch 10*b*, better specified hereunder.

In detail, the accumulation system 8 is suitably realized by principal brushes 11, positioned at opposite sides of the self-propelled apparatus.

In particular, there are provided two brushes 11 of the cup type, i.e. truncated cone shaped, which rotate about the axis of said truncated cone, transverse to the ground.

These brushes 11 have at ground level centres of rotation 11*a* spaced from one another and the line that joins—in the plane—these centres of rotation 11*a* is herein called reference line 10*a*.

The reference line 10*a* is transverse to the longitudinal axis 1*a* and is preferably, compatible with the assembly precision and oscillations of the brushes 11 during operation, perpendicular to the longitudinal axis 1*a*.

Said conveying stretch 10*b* is positioned on the reference line 10*a* and corresponds to the free stretch of said line between the two brushes 11.

There can also be present other additional brushes 11*b*, such as the front brush shown in FIG. 2.

The apparatus 1 also comprises a collection system 12 of the refuse 5, preferably of suction type, as visible from the drawings, the collection system 12 is arranged spaced from the brushes 11 between the brushes 11 and the rear steering wheels 4, and is supported unrotably by the apparatus frame, It collects the refuse 5 present in proximity to a collection inlet 13 positioned at ground level and having a width transverse to the longitudinal axis 1*a* substantially smaller than the width of the frame of the apparatus 1.

Inside this collection inlet 13 there is defined a maximum collection section 13*a*, which realizes the portion of the collection inlet 13 having the greatest width in the direction transverse to the axis 1*a*.

This maximum collection section 13*a* is also preferably at least as wide as the conveying stretch 10*b*.

The collection inlet 13 is preferably disposed so that the maximum collection section 13*a* and the conveying stretch 10*b* are parallel with each other and have the same axis in longitudinal direction, preferably coincident with the axis 1*a*. The collection system 12 also comprises conveying devices 14 of the refuse 5—known per se—which convey the refuse from the collection inlet 13 positioned at ground level to said container 7.

These conveying devices 14 are preferably realized by various types of pneumatic members that operate by sucking up the refuse 5.

In particular, the collection inlet 13 is positioned at the level of a conveying unit 14*a* which directs the air flows at the level of said collection inlet 13.

Moreover, the conveying devices 14 comprise conveying pipes 14*b*, a filter 14*c*, a vacuum pump 14*d*, suitable to allow said suction, and other known devices, such as a device for air recirculation suitable to obtain improved suction of the refuse 5.

In the self-propelled apparatus 1 described above the steering means 3, the accumulation system 8 and the active collection system 12 for suction are predisposed suitably to dispose the axis of steering 3*b* in a particular intermediate position between the conveying stretch 10*b* and the collection inlet 13.

It is seen that along the longitudinal axis 1*a* of the self-propelled apparatus 1, or parallel thereto, there is a segment 15 extending between the collection inlet 13 and the conveying stretch 10*b*.

The axis of steering 3*b*, perpendicular to the longitudinal axis 1*a*, is predisposed so that it intersects the segment 15.

More specifically, the segment 15 joins the reference line 10*a* (or the respective conveying stretch 10*b*) to the section of maximum collection 13*a* of the collection inlet 13 and the axis of steering 3*b* intersects this segment 15 in median position.

For instance, the median portion is between one third and two thirds of the length of the segment 15, or between two fifths and three fifths of this segment 15.

To facilitate this technical solution it is provided that the wheels 4 are all steered and that the steering means 3 can also steer these wheels asymmetrically. It is thus possible to determine an unusual position of the axis of steering 3*b*, for instance, as indicated in the figures, in a position closer to the front wheels than to the rear wheels.

Operation of the self-propelled apparatus 1, the structure of which is described above, is as follows.

In operating conditions the propulsion and control members 2, the accumulation system 8 and the collection system 12 are activated.

The cup brushes 11 rotate about their axes and convey the refuse 5 located in the cleaning area 9 along into and the accumulation strip 10 formed between the brushes 11.

This strip is generated by the conveying stretch 10*b*, which is moved by the movement of the apparatus 1. As specified above, the conveying stretch 10*b* is between the brushes 11 and is positioned along the reference line 10*a*, which joins the centres of rotation 11*a* at ground level of the brushes 11.

The collection system 12 then lifts, by means of suction, the refuse 5 located in proximity to the collection inlet 13 and sends it to the container 7. During rectilinear travel the reference line 10*a*—and therefore the conveying stretch 10*b*—and the maximum collection section 13*a* travel along trajectories that are superposed, as shown in FIG. 3.

The refuse 5 present in the accumulation strip 10 is thus completely collected by the collection inlet 13.

While performing curves or lateral movements, the apparatus 1 instead travels along trajectories having a centre of curvature coincident with the centre of turning 3*a*, positioned along the axis of steering 3*b*.

If the axis of steering 3*b* intersects the segment 15 in a median point thereof, as shown in FIG. 4*a*, the reference line 10*a*—and therefore the conveying stretch 10*b*—and the maximum collection section 13*a* again travel along trajectories that are superposed, as shown in FIG. 4*a*.

The collection inlet 13, during travel of the apparatus 1, thus completely superposes the accumulation strip 10 and the refuse 5 is always completely collected.

On the contrary, as shown in FIG. 4*b*, if the apparatus 1 does not have an axis of steering 3*b* positioned as explained above, the conveying stretch 10*b* and the section of maximum collection 13*a* would travel along different trajectories. During travel of the apparatus 1, the collection inlet 13 would therefore only partly superpose the accumulation strip 10, leaving areas of uncollected refuse 5.

The invention achieves important advantages.

In fact, the apparatus allows the whole of the accumulation strip 10 to be swept. Therefore, it is unnecessary to increase the dimensions of the collection inlet 13 and therewith the suction power of the apparatus, or to produce a structure of the apparatus that requires the collection inlet 13 to be placed in close proximity to the brushes 11.

What I claim is:

1. A Self-propelled apparatus for cleaning roads and urban areas, said apparatus comprising:

a frame defining a longitudinal axis (1*a*) parallel to the direction of rectilinear motion of said apparatus, a propulsion and control members (2) including front and rear wheels (4) and steering means (3) for said wheels (4), said steering means (3) defining a center of turning (3*a*) and an axis of steering (3*b*), said axis of steering (3*b*) being perpendicular to said longitudinal axis (1*a*) and passing through said center of turning (3*a*);

an accumulation system (8) of refuse (5) on the ground comprising at least two rotatable brushes (11) at ground level having centers of rotation (11*a*) spaced from each other and defining a reference line (10*a*) perpendicular to said longitudinal axis (1*a*), and passing through said centers of rotation (11), said brushes (11) conveying said refuse (5) from a cleaning area (9) into an accumulation strip (10) formed between said brushes (11), a collection system (12) arranged spaced from said brushes (11) between said brushes (11) and said rear steering wheels (4) and supported unrotably by said frame, said collection system (12) comprising a collection inlet (13) having a width transverse to said longitudinal axis (1*a*) substantially smaller than a width of said frame and being positioned substantially at ground level to suck up said refuse (5), wherein said steering means (3), said accumulation system (8) and said collection system (12) are disposed relative to each other in such a way that said axis of steering (3*b*) lies in a position intersecting a central portion between one third and two thirds of a segment (15) parallel to said longitudinal axis (1*a*) and extending between said collection inlet (13) and said reference line (10*a*).

2. Apparatus according to claim 1, wherein said steering means (3) are suitable to steer said wheels (4) asymmetrically.

3. Apparatus according to claim 1, wherein said axis of steering intersects said segment (15) in a central portion thereof, between two fifths and three fifths of the length thereof.

4. Apparatus according to claim 1, wherein said reference line (10*a*) comprises a conveying stretch (10*b*) corresponding with the size of the distance between said brushes (11) at ground level, and wherein said collection inlet (13) defines a maximum collection section (13*a*) having a dimension at least the same as said conveying stretch (10*b*).

5. Apparatus according to claim 1, wherein said collection inlet (13) defines a maximum collection section (13*a*) and wherein said maximum collection section (13*a*) and said reference line (10*a*) are substantially parallel to each other and perpendicular to said longitudinal axis (1*a*).

* * * * *